United States Patent [19]

Ryan

[11] Patent Number: 5,052,143

[45] Date of Patent: Oct. 1, 1991

[54] PISTOL STOCK SPREADING TOOL KIT

[76] Inventor: John T. Ryan, 16022 Crest Dr., Woodbridge, Va. 22191

[21] Appl. No.: 508,829

[22] Filed: Apr. 13, 1990

[51] Int. Cl.[5] ..... F41C 27/00

[52] U.S. Cl. ..... 42/90; 42/71.02; 29/239; 29/270

[58] Field of Search ..... 29/239, 270; 42/71.01, 42/71.02, 90, 106; 72/458, 479

[56] References Cited

U.S. PATENT DOCUMENTS 4,638,582 1/1987 Farrar ..... 42/71.01

FOREIGN PATENT DOCUMENTS 740953 11/1955 United Kingdom ..... 29/270

*Primary Examiner*—Stephen C. Bentley
*Attorney, Agent, or Firm*—Leon Gilden

[57] ABSTRACT

An apparatus is set forth to spread a pistol stock or grip relative to the associated framework of the pistol to permit ease of removal of the associated stock from the pistol framework. The tool includes an elongate rod, including a handle member transversely and integrally mounted to an upper end of the rod, with a head member mounted at a lowermost end of the rod. The head member includes an elongate rectangular cross-sectional member, including arcuate corners spaced from and parallel to the axis of the head longitudinally aligned with the rod. The kit includes a series of further head members selectively mounted to the rod, wherein the head members include a tapered wedge-shaped member including planar sides and arcuate tapering corners, as well as a further wedge-shaped member defined by an elliptical cross-sectional configuration. The tool further includes at least one sleeve member slidably mounted on the head member to provide various cross-sectional configurations for insertion within magazine wells of pistols of various dimensions. The sleeve is formed of a rigid cellular or polymeric material, as are the head and further head members utilized in the kit assemblage.

7 Claims, 4 Drawing Sheets

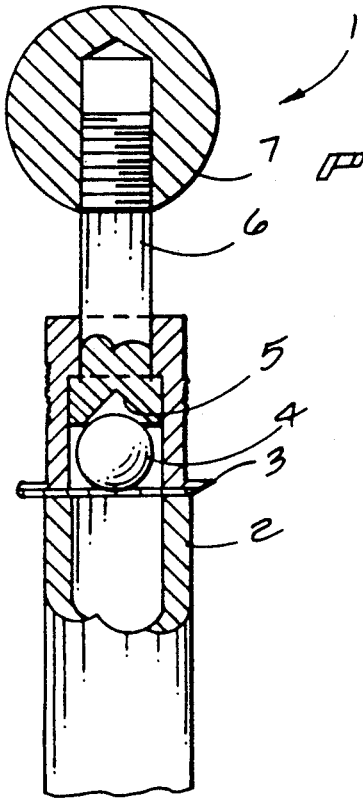
FIG 1
PRIOR ART
FIG 2
PRIOR ART
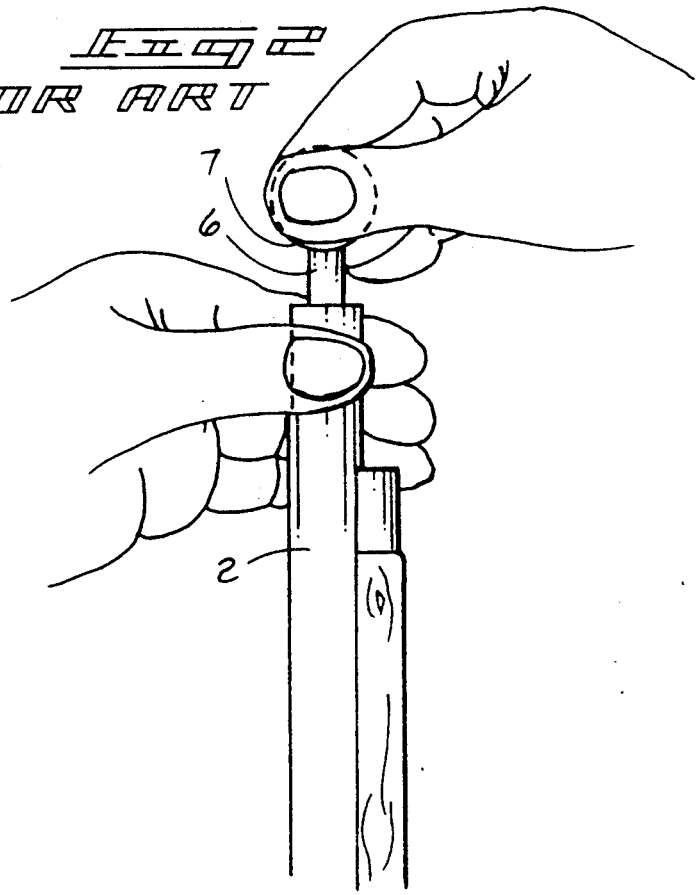

Fig 5
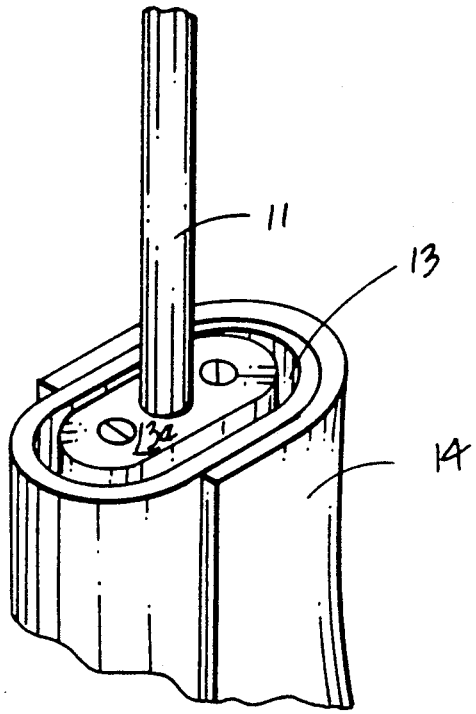
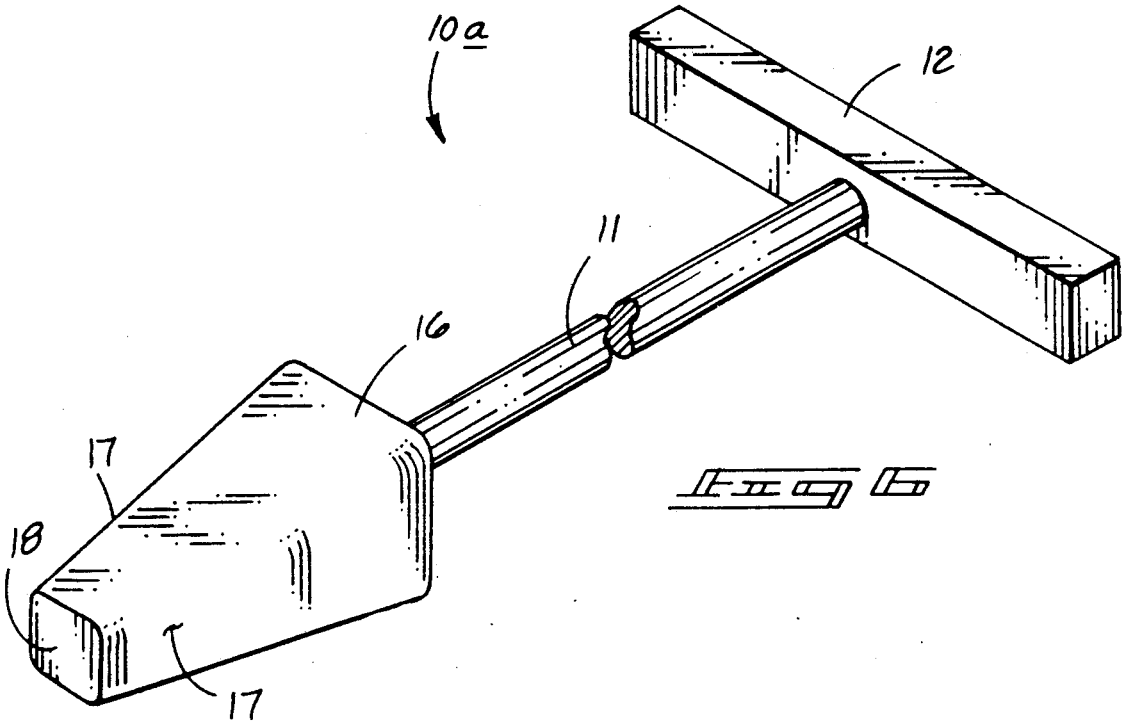
Fig 6

FIG 7
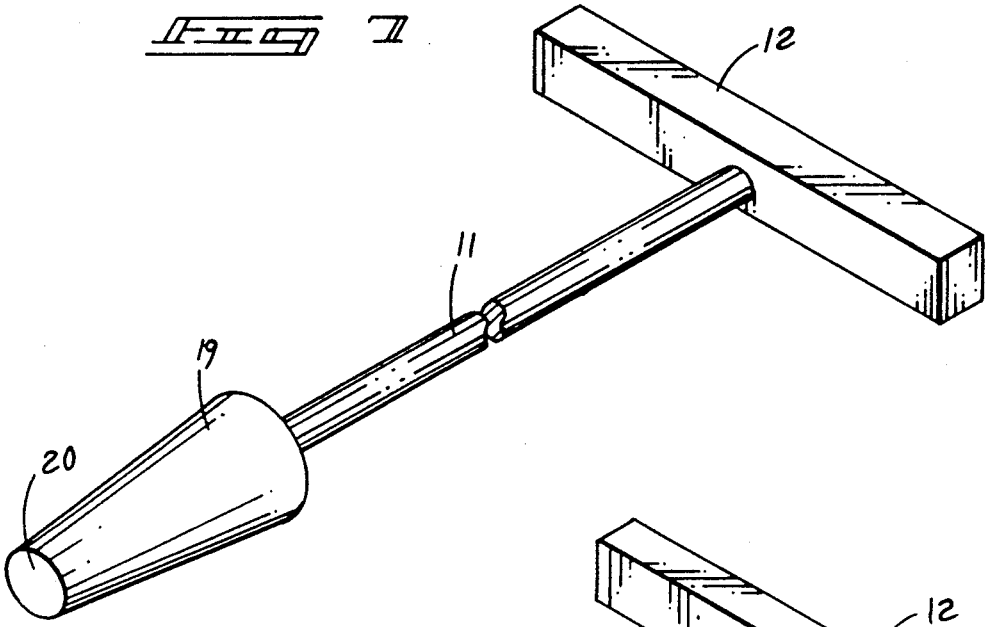
FIG 8
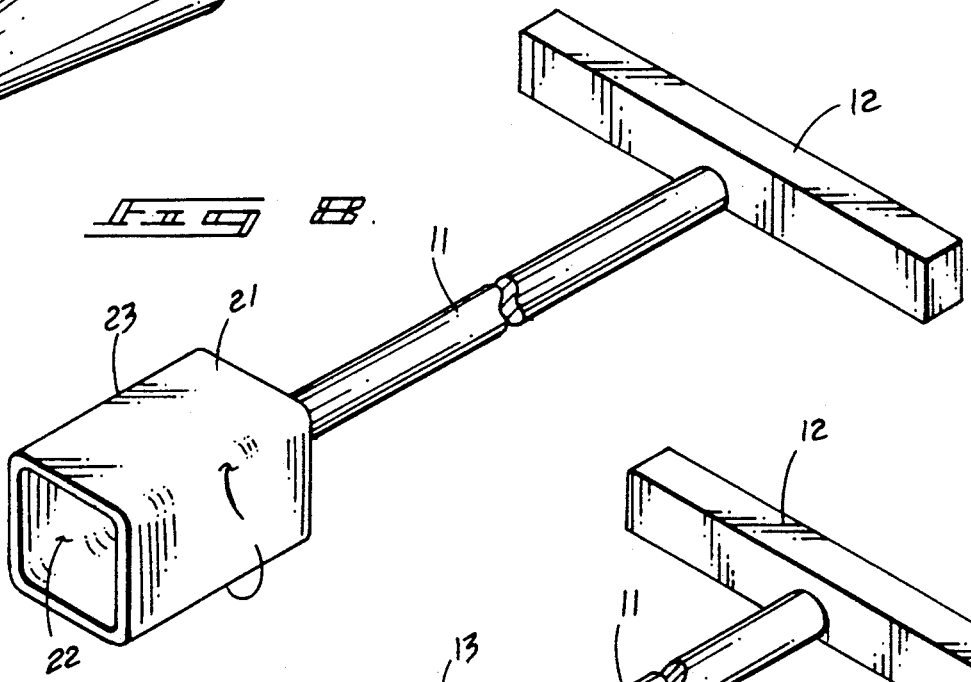
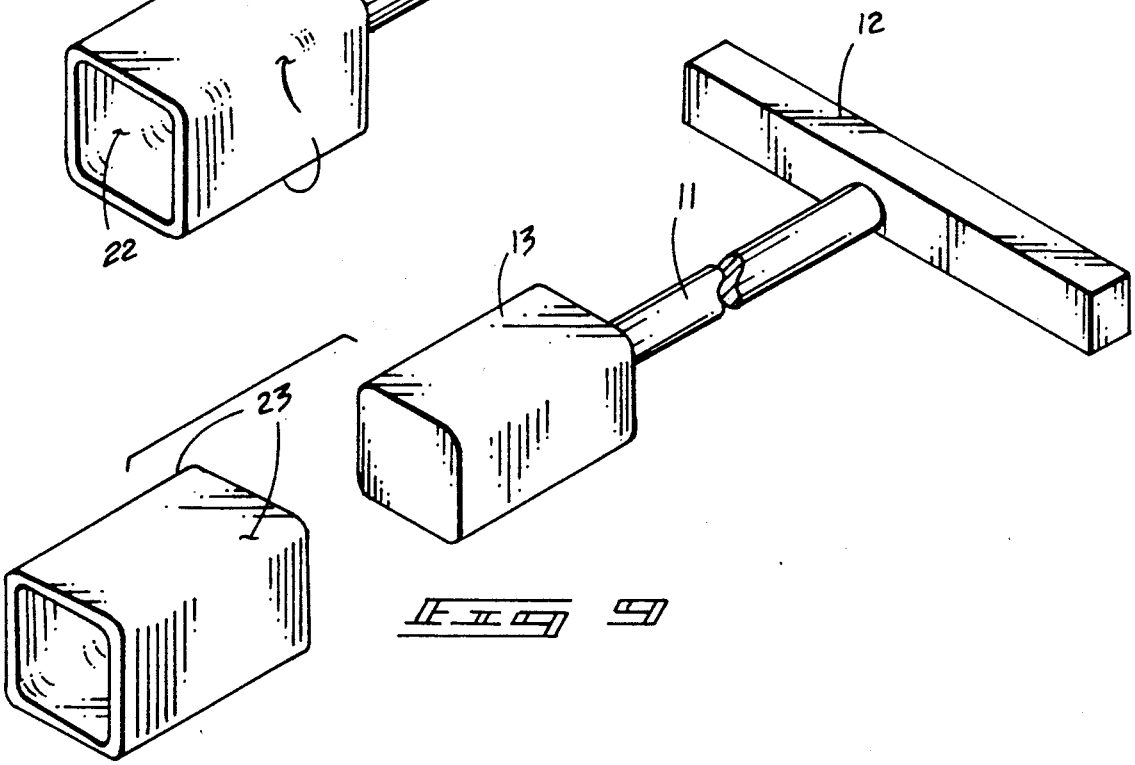
FIG 9

PISTOL STOCK SPREADING TOOL KIT

BACKGROUND OF THE INVENTION

1. Field of the Invention

The field of invention relates to firearm tools, and more particularly pertains to a new and improved pistol stock spreading tool kit wherein the same permits ease of insertion of the tool within a magazine well of an associated pistol to permit spreading of a pistol grip or stock mounted therearound.

2. Description of the Prior Art

Firearm tools of various types are utilized by individuals and gunsmiths in the repair and maintenance of various firearms. In the prior art, pistol grips or stocks that are mounted in a fixed configuration about an associated pistol frame for an extended period of time tend to become affixed thereto due to shrinkage of the wood, interaction with solvents and chemicals and the metallic framework and the like. Examples of prior art firearm tools may be found in U.S. Pat. No. 3,747,252 to Walker wherein a tool is positionable overlying a pistol barrel to permit insertion of a projectile for use with black powder firearms operation.

U.S. Pat. No. 4,195,432 to Hickman provides a tool defining a yoke to adjust distance between barrels of dual barrel shotguns.

U.S. Pat. No. 4,344,245 to Miller sets forth a tool for extending the barrel of a revolver crane and for checking alignment of the crane barrel and cylinder locking aperture in an associated revolver frame.

U.S. Pat. No. 4,094,086 to Gevers sets forth a wedge-type tool for adjusting spacing of barrels of a dual barrel shotgun to alter impact points of the barrels relative to one another.

U.S. Pat. No. 4,603,497 to Crimmins sets forth a means for securing and aligning barrels of two pistols to permit the grasping of the pistols by both hands of an individual and permitting simultaneous fire, wherein stability of the two pistols is provided during the firing procedure.

As such, it may be appreciated that there continues to be a need for a new and improved pistol stock spreading tool kit wherein the same addresses both the problems of ease of use as well as effectiveness in construction in permitting ease of removal of an associated pistol stock from a pistol framework and in this respect, the present invention substantially fulfills this need.

SUMMARY OF THE INVENTION

In view of the foregoing disadvantages inherent in the known types of firearm tools now present in the prior art, the present invention provides a pistol stock spreading tool kit wherein the same permits insertion of the tool within a magazine well of an associated pistol and upon rotation of the tool, spreads the associated stock from a pistol framework to permit release of the stock therefrom and removal of the stock from the framework. As such, the general purpose of the present invention, which will be described subsequently in greater detail, is to provide a new and improved pistol stock spreading tool kit which has all the advantages of the prior art firearm tools and none of the disadvantages.

To attain this, the present invention provides an, apparatus to spread a pistol stock or grip relative to the associated framework of the pistol to permit ease of removal of the associated stock from the pistol framework. The tool includes an elongate rod, including a handle member transversely and integrally mounted to an upper end of the rod, with a head member mounted at a lowermost end of the rod. The head member includes an elongate rectangular cross-sectional member, including arcuate corners spaced from and parallel to the axis of the head longitudinally aligned with the rod. The kit includes a series of further head members selectively mounted to the rod, wherein the head members include a tapered wedge-shaped member including planar sides and arcuate tapering corners, as well as a further wedge-shaped member defined by an elliptical cross-sectional configuration. The tool further includes at least one sleeve member slidably mounted on the head member to provide various cross-sectional configurations for insertion within magazine wells of pistols of various dimensions. The sleeve is formed of a rigid cellular or polymeric material, as are the head and further head members utilized in the kit assemblage.

My invention resides not in any one of these features per se, but rather in the particular combination of all of them herein disclosed and claimed and it is distinguished from the prior art in this particular combination of all its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pistol stock spreading tool kit which has all the advantages of the prior art firearm tools and none of the disadvantages.

It is another object of the present invention to provide a new and improved pistol stock spreading tool kit which may be easily and efficiently manufactured and marketed.

It is a further object of the present invention to provide a new and improved pistol stock spreading tool kit which is of a durable and reliable construction.

An even further object of the present invention is to provide a new and improved pistol stock spreading tool kit which is susceptible of a low cost of manufacture with regard to both materials and labor, and which accordingly is then susceptible of low prices of sale to the consuming public, thereby making such pistol stock spreading tool kit economically available to the buying public.

Still yet another object of the present invention is to provide a new and improved pistol stock spreading tool kit which provides in the apparatuses and methods of the prior art some of the advantages thereof, while simultaneously overcoming some of the disadvantages normally associated therewith.

Still another object of the present invention is to provide a new and improved pistol stock spreading tool kit wherein the same permits ease of removal and disassembly of a pistol stock from an associated pistol frame upon insertion of the tool within a cavity defined by the magazine well within a pistol grip frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view, partially in section, of a prior art firearm tool.

FIG. 2 is an isometric illustration of the prior art tool of FIG. 1 in use with an associated firearm.

FIG. 5 is an isometric illustration of the tool and its insertion within a magazine well of an associated pistol.

FIG. 6 is an isometric illustration of a modified head utilized by the instant invention.

FIG. 7 is an isometric illustration of a further modified head utilized by the instant invention.

FIG. 8 is an isometric illustration of a sleeve for use with the tool of the instant invention.

FIG. 9 is an isometric illustration, somewhat exploded, of the sleeve for use with the instant invention.

DESCRIPTION OF THE PREFERRED EMBODIMENT

Figure 3:
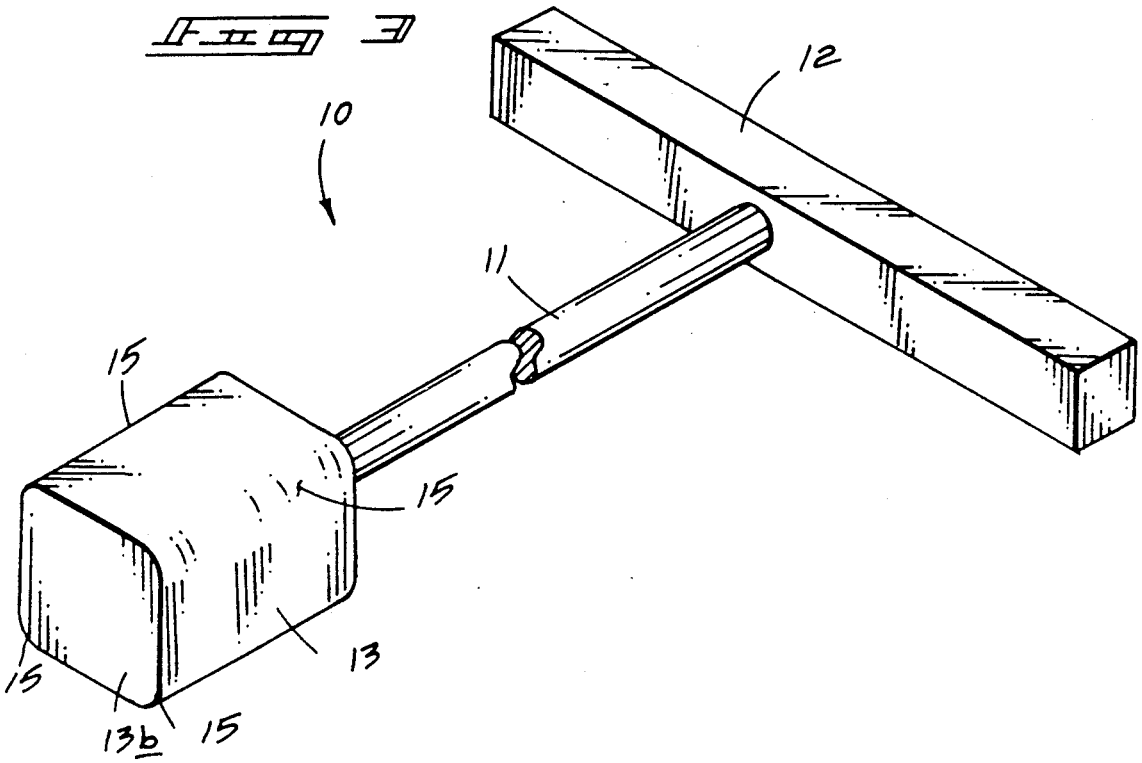
FIG. 3 is an isometric illustration of the instant invention.
Figure 4:
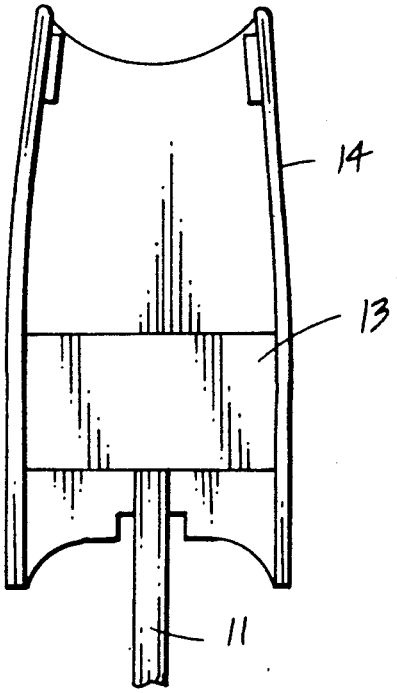
FIG. 4 is an orthographic view, taken in elevation, of the instant invention positioned within a pistol grip member.

With reference now to the drawings, and in particular to FIGS. 1 to 9 thereof, a new and improved pistol stock spreading tool kit embodying the principles and concepts of the present invention and generally designated by the reference numerals 10 and 10*a* will be described.

FIG. 1 illustrates a prior art firearm tool 1, wherein the tool is positioned concentrically with an overlying forward end of a barrel muzzle 2, with a patch 3 underlying a projectile sphere 4 that is received within a convex cavity 5 formed at a lower terminal end of the rod 6 of the tool. A handle 7 permits manual grasping of the tool to plunge and direct the associated patch and projectile within the barrel 2.

More specifically, the pistol stock spreading tool kit 10 of the instant invention essentially comprises an elongate longitudinally aligned rod 11 fixedly mounting a handle 12 at its rear terminal end, wherein the handle is transversely aligned relative to the rod 11, with the rod positioned medially of the handle 12 to permit ease of rotation of a spreader block 13 defining a head member mounted at a forward terminal end of the rod 11. The spreader block 13 is longitudinally aligned with the rod 11, as well as coaxially aligned therewith. The spreader block is formed of either cellular or polymeric material to minimize marring or scuffing of an interior surface of an associated pistol stock 14 that the spreader block 13 is in contact with during its use. The spreader block includes arcuate elongate corners 15 that are spaced from and parallel to the medial longitudinal axis of the symmetrically formed spreader block 13. The arcuate corners 15 permit ease of rotation of the spreader block 13 when inserted interiorly of the associated pistol stock 14. In use, the block 13 is of a generally rectangular configuration as inserted within a magazine well of an associated pistol, as illustrated in FIG. 5 for example. The spreader block subsequently is rotated, wherein the arcuate corners 15 permits ease of such rotation and spreading of the associated pistol stock 14 within the magazine well. The spreader block 13 is formed with a blunt forward face 13*b*, wherein a plate 13*a* is mounted to the rear face of the spreader block and held thereto by a plurality of fasteners, as illustrated in FIG. 5.

FIG. 6 illustrates a modified tool forming a part of the tool kit assemblage, wherein a wedge-shaped block 16 includes forwardly tapering planar sides tapering to a blunt forward face 18. The blunt forward face of each of the spreader blocks permits greater effective use of the planar sides utilized in the spreading of an associated pistol stock. The wedge-shaped spreader block 16 accommodates a greater dimensional variety of pistol stocks and is also formed with arcuate corners 17 for the reasons as set forth above. A further spreader block that may be selectively mounted onto the rod 11 by use of the same plate 13*a* is defined by an elliptical cross-sectional configuration forwardly tapering modified wedge-block 19. The elliptical cross-sectional configuration wedge-block 19 is also formed with a blunt forward elliptical face 20 that configuration permits ease of insertion of the block within a greater range of pistol magazine wells, per the illustration of FIG. 5.

FIG. 8 illustrates the use of a sleeve 21 formed of a cellular or polymeric material comparable to that of the spreader block construction and is formed with a central cavity 22 of a predetermined cross-sectional configuration equal to the exterior cross-sectional configuration of the spreader block 13, as illustrated in FIG. 9. The sleeve is also formed with the requisite rounded or arcuate corners 23.

Accordingly, the kit utilizes a range of spreader blocks or head members selectively utilized with the associated rod 11 and handle 12 to accommodate a variety of configurations of magazine wells and pistol stocks permitting ease of spreading of such a stock relative to the framework of the pistol permitting ease of removal of the stock relative thereto.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol stock spreading tool kit for selective insertion within a magazine well of an associated pistol framework, wherein the kit comprises, an elongate longitudinally aligned rigid rod, the rod including a forward terminal end and a rear terminal end, the rear terminal end fixedly mounting a handle orthogonally thereto, the handle fixedly mounted medially of its length to the rear terminal end of the elongate rod, and a spreader block, wherein the spreader block includes a longitudinally aligned axis, the longitudinally aligned axis coextensively aligned with the elongate rod, and wherein the spreader block includes a blunt rear face and a blunt forward face, and is defined by planar parallel side walls, the planar parallel side walls joined at arcuate corners, wherein the arcuate corners permit ease of rotation of the spreader block within the pistol stock.

2. A tool kit as set forth in claim 1 wherein the elongate rod includes a plate member orthogonally mounted to the forward terminal end of the elongate rod, and the plate mounted to the rear face of the spreader block.

3. A tool kit as set forth in claim 2 further including an additional spreader block selectively mounted to the plate, the additional spreader block defined by a wedge-shaped configuration, wherein the planar side walls taper forwardly to the forward blunt face, and wherein the forward blunt face is defined by a cross-sectional configuration less than a further cross-sectional configuration defined by the rear blunt face.

4. A tool kit as set forth in claim 3 further including a yet further spreader block, wherein the yet further spreader block is defined by an elliptical cross-sectional configuration, and wherein the yet further spreader block tapers to a reduced forward blunt face from a rear enlarged blunt face selectively mounted to the plate.

5. A tool kit as set forth in claim 4 wherein the spreader block includes a sleeve member selectively mounted overlying the spreader block.

6. A tool kit as set forth in claim 5 wherein the sleeve is defined by an internal cavity, wherein the internal cavity is defined by a predetermined cross-sectional configuration substantially equal to the external cross-sectional configuration of the spreader block.

7. A tool kit as set forth in claim 6 wherein the sleeve includes planar sleeve side walls, and the planar sleeve side walls converge at arcuate sleeve corners.

* * * * *